US010653941B2

(12) United States Patent
Lyons et al.

(10) Patent No.: US 10,653,941 B2
(45) Date of Patent: May 19, 2020

(54) LAG WINNER DETERMINATION AND TRAINING APPARATUS AND METHOD OF USE

(71) Applicants: Matt Lyons, Flemington, NJ (US); Frank Carbone, Lambertville, NJ (US)

(72) Inventors: Matt Lyons, Flemington, NJ (US); Frank Carbone, Lambertville, NJ (US)

( * ) Notice: Subject to any disclaimer, the term of this patent is extended or adjusted under 35 U.S.C. 154(b) by 10 days.

(21) Appl. No.: 16/195,236

(22) Filed: Nov. 19, 2018

(65) Prior Publication Data

US 2019/0160369 A1 May 30, 2019

Related U.S. Application Data

(60) Provisional application No. 62/591,574, filed on Nov. 28, 2017.

(51) Int. Cl.
*A63D 15/00* (2006.01)
*A63D 15/20* (2006.01)

(52) U.S. Cl.
CPC ..... *A63D 15/20* (2013.01); *A63D 15/006* (2013.01)

(58) Field of Classification Search
CPC ..... A63D 15/20; A63D 15/006
USPC ..... 473/1, 2, 5, 17, 44, 52, 219, 220
See application file for complete search history.

(56) References Cited

U.S. PATENT DOCUMENTS

| | | | |
|---|---|---|---|
| 529,731 | A | 11/1894 | Gschwendtner |
| 753,392 | A | 3/1904 | Haskell |
| 3,448,459 | A | 6/1969 | Margolis |
| 3,947,026 | A | 3/1976 | Scoutten |
| 4,178,694 | A | 12/1979 | Bonney |
| 4,337,943 | A | 7/1982 | Stewart |
| 4,688,796 | A | 8/1987 | Wright |
| 4,882,676 | A | 11/1989 | Van De Kop et al. |
| 5,275,398 | A | 1/1994 | Compton |
| 5,338,262 | A | 8/1994 | Hayes |
| 5,554,075 | A | 9/1996 | Glazer |
| 5,611,739 | A | 3/1997 | Carney |
| 5,709,609 | A | 1/1998 | Carney |
| 5,738,595 | A | 4/1998 | Carney |
| 5,769,728 | A | 6/1998 | Kasino |
| 6,117,019 | A | 9/2000 | Taylor |
| 6,132,319 | A | 10/2000 | Schluter |
| 6,155,929 | A | 12/2000 | Chipman |
| 6,165,078 | A | 12/2000 | Holt |

(Continued)

FOREIGN PATENT DOCUMENTS

| | | |
|---|---|---|
| CH | 700475 | 8/2010 |
| CN | 201011525 | 1/2008 |

(Continued)

*Primary Examiner* — Mitra Aryanpour
(74) *Attorney, Agent, or Firm* — Gearhart Law LLC

(57) ABSTRACT

A device for determining a lag winner in billiards and method of use are provided. The method disclosed includes placing a lag winner determination device such that the device is alongside a side rail of the billiards table and closer to a head rail of the billiards table than billiard balls used in the lag. The method further includes activating an illumination source within the lag winner determination device and moving the illumination source until it provides incident light to one of the billiard balls used in the lag. The method further includes determining the winner as a player that used the billiard ball that received the incident light from the illumination source.

5 Claims, 12 Drawing Sheets

(56) References Cited

U.S. PATENT DOCUMENTS

| | | | | |
|---|---|---|---|---|
| 6,364,783 | B1 | 4/2002 | Kellogg, Jr. et al. | |
| 6,609,307 | B1 | 8/2003 | Haynes et al. | |
| 6,746,336 | B1 | 6/2004 | Brant et al. | |
| 6,769,992 | B1 * | 8/2004 | Domulevicz | A63D 15/006 473/2 |
| 6,827,651 | B1 | 12/2004 | Davis | |
| 7,147,566 | B2 | 12/2006 | Keating | |
| 7,247,101 | B2 | 7/2007 | Maurer | |
| 7,303,483 | B2 | 12/2007 | Black | |
| 7,611,416 | B1 | 11/2009 | Mattina et al. | |
| 9,646,199 | B2 | 5/2017 | Bose et al. | |
| 2003/0059752 | A1 | 3/2003 | Gratkowski et al. | |
| 2004/0132535 | A1 | 7/2004 | Sumko | |
| 2004/0204256 | A1 | 10/2004 | Francisco | |
| 2005/0009613 | A1 | 1/2005 | Davis | |
| 2005/0037851 | A1 | 2/2005 | Evers | |
| 2005/0209013 | A1 | 9/2005 | Davis et al. | |
| 2006/0128488 | A1 | 6/2006 | Pappas | |
| 2006/0166752 | A1 | 7/2006 | Black | |
| 2008/0111305 | A1 | 5/2008 | London | |
| 2008/0125233 | A1 | 5/2008 | Tucker | |
| 2008/0132344 | A1 | 6/2008 | Malek | |
| 2009/0143156 | A1 | 6/2009 | Schulze | |
| 2009/0186713 | A1 | 7/2009 | Johnson | |
| 2009/0233725 | A1 | 9/2009 | Stuart | |
| 2009/0258718 | A1 | 10/2009 | Cyr et al. | |
| 2009/0275417 | A1 | 11/2009 | Bergstrom | |
| 2010/0012054 | A1 | 5/2010 | Justin et al. | |

FOREIGN PATENT DOCUMENTS

| | | | |
|---|---|---|---|
| CN | 103349835 | | 10/2013 |
| CN | 104826328 | | 8/2015 |
| CN | 104874171 | | 9/2015 |
| CN | 204699367 | | 10/2015 |
| DE | 3730855 | | 3/1989 |
| DE | 20301254 | U1 | 4/2003 |
| DE | 102014111598 | | 2/2016 |
| EP | 1339465 | | 2/2010 |
| FR | 5502 | E | 4/1906 |
| FR | 430895 | | 10/1911 |
| FR | 1086139 | | 2/1955 |
| FR | 2884434 | | 12/2013 |
| GB | 303218 | | 1/1929 |
| GB | 1242203 | | 8/1971 |
| GB | 8830353 | | 2/1989 |
| GB | 2243085 | | 3/1994 |
| GB | 2348149 | | 9/2000 |
| GB | 2387552 | | 7/2006 |
| GB | 2481031 | | 12/2011 |
| JP | 2002186702 | | 7/2002 |
| JP | 2010081947 | | 4/2010 |
| KR | 200177767 | | 1/2000 |
| KR | 1020090115091 | | 11/2009 |
| KR | 1020100015258 | | 2/2010 |
| KR | 1020100127451 | | 12/2010 |
| KR | 1020120039302 | | 4/2012 |
| KR | 101145126 | | 5/2012 |
| KR | 1020120113578 | | 10/2012 |
| KR | 101267908 | | 5/2013 |
| KR | 1020140011604 | | 1/2014 |
| KR | 101386034 | | 4/2014 |
| KR | 1020170013303 | | 2/2017 |
| KR | 101713641 | | 3/2017 |
| WO | 2008052512 | | 5/2008 |
| WO | 2009126982 | | 10/2009 |

* cited by examiner

LAG WINNER DETERMINATION AND TRAINING APPARATUS AND METHOD OF USE

CLAIM OF PRIORITY

This application claims priority to U.S. Application 62/591,574 filed on Nov. 28, 2017, the contents of which are hereby fully incorporated by reference in its entirety.

FIELD OF THE EMBODIMENTS

The present invention and its embodiments relate generally to gaming, and more particularly to an apparatus and method for determining a lag winner in a billiards game.

BACKGROUND OF THE EMBODIMENTS

Billiards games can be classified into two broad categories: pocket billiards and carom billiards. Pocket billiard games are played on tables with pockets, whereas carom billiards games are played on tables that have no pockets. In pocket billiards, the objectives of the particular game are usually to pocket balls. In carom billiards, the objectives are more towards moving the object balls around the table with the cue ball in a particular fashion. For the purposes of this disclosure, American pool, snooker, the various forms of carom billiards, and English pool, are all considered "billiards." Billiards in various forms are extremely popular throughout the world. Review of related technology:

U.S. Patent Application 2006/0128488 pertains to a pocket billiards instructional device including a stand, a target optical head, and an object optical head. The target optical head defines a principal axis and is selectively rotatable thereabout. The target optical head is operative to emit a target optical beam and is attachable to the stand. The object optical head is operative to emit an object optical beam, is selectively rotatable about the principal axis relative to the target optical head and is attachable to the stand.

U.S. Patent Application 2005/0037851 pertains to a method of conditioning participants in games of billiards or the like to visualize the geometry underlying the pocketing of an object ball as the result of impact by a cue ball through the employment of a training device adapted to be positioned above the playing surface. The device includes a base member rotatable in a horizontal plane, said base member housing three laser light-emitting sources, the first of which is focused downwardly to illuminate a selected object ball, the second of which downwardly projects a line path from the illuminated object ball to the designated pocket, and the third of which is directed downwardly to emit a beam focused on the "aim spot," said first and third laser light emitting sources being positioned perpendicular to the playing surface, parallel to each other, and spaced one object ball diameter apart, whereby when the propelled cue ball rolls over the "aim spot," it impacts the proximate object ball causing it to travel along the illuminated line path to the designated target.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

According to an aspect of the present invention, there is provided a method for determining a winner for a lag in a billiards game occurring on a billiards table, comprising: placing a lag winner determination device such that the device is alongside a side rail of the billiards table and closer to a head rail of the billiards table than billiard balls used in the lag; activating an illumination source within the lag winner determination device; moving the illumination source until it provides incident light to one of the billiard balls used in the lag; and determining the winner as a player that used the billiard ball that received incident light from the illumination source.

According to another aspect of the present invention, activating an illumination source comprises activating a laser.

According to another aspect of the present invention, activating a laser comprises activating a helium-neon gas laser.

According to another aspect of the present invention, activating a laser comprises activating a diode laser.

According to another aspect of the present invention, activating a diode laser comprises activating a diode laser with a light wavelength ranging from 400 nanometers to 750 nanometers.

According to another aspect of the present invention, there is provided an apparatus comprising an enclosure; a power source disposed within the enclosure; a light source coupled to the power source, wherein the light source is attached to the enclosure and configured and disposed to illuminate a billiard ball on a billiards table; and a switch configured and disposed to activate the light source.

According to another aspect of the present invention, the light source comprises a laser.

According to another aspect of the present invention, the laser comprises a helium-neon laser.

According to another aspect of the present invention, the laser comprises a diode laser.

According to another aspect of the present invention, the laser comprises a diode-pumped solid state laser.

According to another aspect of the present invention, the laser is configured to output light with a light wavelength ranging from 400 nanometers to 750 nanometers.

According to another aspect of the present invention, the laser is configured to output light with a light wavelength ranging from 495 nanometers to 570 nanometers.

According to another aspect of the present invention, the laser is configured to output light with a light wavelength ranging from 620 nanometers to 750 nanometers.

According to another aspect of the present invention, the laser is configured to output light with a light wavelength ranging from 450 nanometers to 494 nanometers.

According to another aspect of the present invention, the apparatus further includes a rail disposed along a longitudinal axis of the enclosure, and wherein the laser is configured to move along the rail.

According to another aspect of the present invention, the apparatus further includes a plurality of elongated supports disposed on a bottom surface of the enclosure.

According to another aspect of the present invention, the apparatus further includes a second laser, wherein the laser is configured to output light at a first wavelength, and wherein the second laser is configured to output light at a second wavelength, and wherein the laser and the second laser are oriented such that a light beam from the laser is oriented parallel to a light beam from the second laser.

According to another aspect of the present invention, the power source includes a rechargeable battery.

According to another aspect of the present invention, the rechargeable battery comprises a nickel cadmium battery.

According to another aspect of the present invention, the rechargeable battery comprises a lithium ion battery.

According to another aspect of the present invention, the plurality of elongated supports comprises three supports.

According to another aspect of the present invention, the plurality of elongated supports comprises four supports.

BRIEF DESCRIPTION OF THE DRAWINGS

The structure, operation, and advantages of disclosed embodiments will become further apparent upon consideration of the following description taken in conjunction with the accompanying figures. The figures are intended to be illustrative, not limiting. Certain elements in some of the figures may be omitted, or illustrated not-to-scale, for illustrative clarity.

DESCRIPTION OF THE PREFERRED EMBODIMENTS

A billiards game may typically start by lagging, which is a process to determine which player will go first to start the actual billiards game. The winner of the lag determines who goes first.

Regardless of the type of billiards game, the lag process typically involves each player lining up their ball near the head rail of the billiards table, and trying to return the ball as close as possible to the head rail after bouncing off the foot rail. The player whose ball stops closest to the head rail wins the lag, and gets his/her choice of whether to shoot first or require his/her opponent to shoot first. For many games, the lag winning player will want to shoot first. However, for some games, such as straight pool, the lag winner may want to go second in order to force his/her opponent break up the rack.

Figure 1:
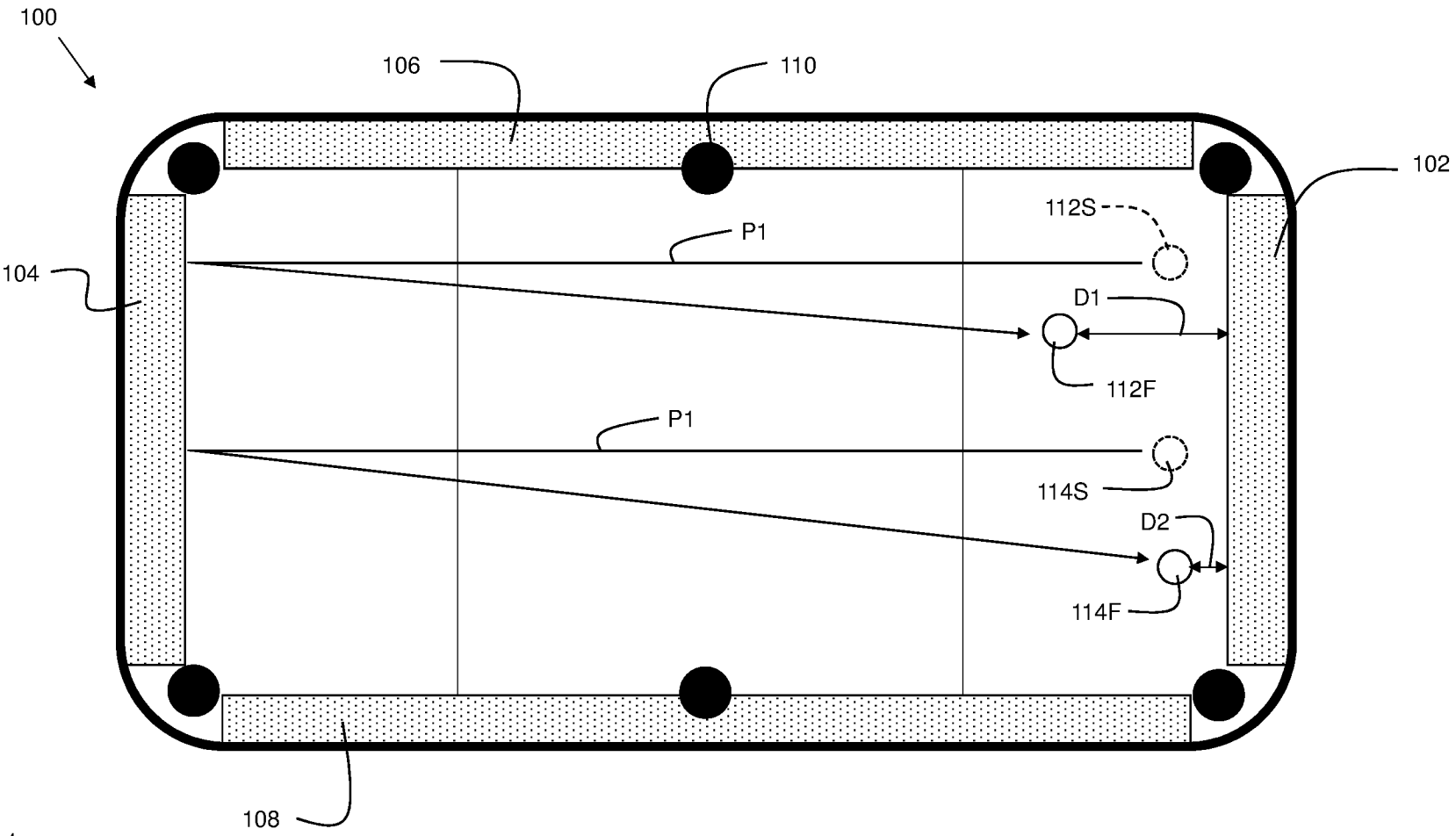
FIG. 1 is a top-down view of a billiards table indicating a lag process.

Referring now to FIG. 1, a top-down view of a billiards table 100 indicating a lag process is shown. Table 100 includes head rail 102, foot rail 104, side rail 106, and side rail 108. Table 100 includes six pockets, indicated generally as 110. As previously stated, some billiards tables do not have pockets. Embodiments of the present invention are well-suited for both pocket, and carom (no pockets) billiards.

To begin the lag process, a first player may place a billiard ball at a location 112S, and then strike the ball with a cue, forcing the ball to travel along path P1, striking the foot rail 104, and bouncing back towards the head rail 102, coming to a rest at position 112F, which is a distance D1 from the head rail 102. Similarly, a second player may place a billiard ball at a location 114S, and then strike the ball with a cue, forcing the ball to travel along path P2, striking the foot rail 104, and bouncing back towards the head rail 102, coming to a rest at position 114F, which is a distance D2 from the head rail 102. In this example, since D2 is less than D1, the second player has won this lag, and thus gets to decide which player will start the game.

Figure 2:
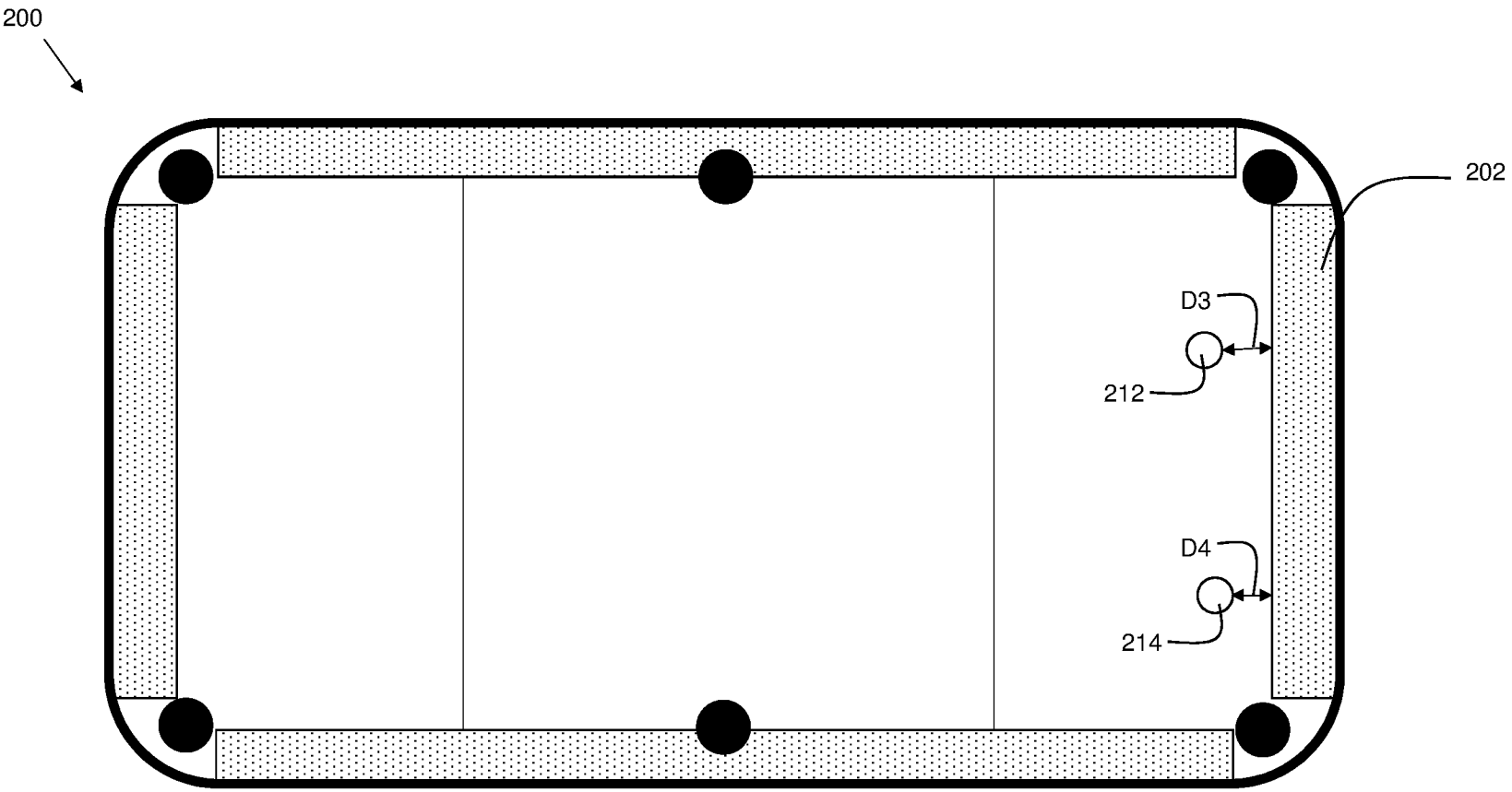
FIG. 2 illustrates a close lag.

FIG. 2 illustrates a top-down view of a billiards table 200 after both players have performed a lag process, and illustrates a close lag. In this example, a first player has performed a lag attempt and positioned his ball 212 at a distance D3 from head rail 202. Similarly, the second player has also performed a lag attempt and positioned his ball 214 at a distance D4 from head rail 202.

Referring once again to the example illustrated in FIG. 1, player 2 was the clear winner, since D2 is considerably less than D1.

However, in the example of FIG. 2, it is difficult to manually determine the winner, since the difference between D3 and D4 is quite small as compared with the difference between D1 and D2 of FIG. 1. With experienced players, who are skilled at positioning a ball near the head rail, it can therefore be challenging to manually determine which player won a lag. Thus, embodiments include determining the winner as a player that used the billiard ball that received the incident light from the illumination source.

Figure 3:
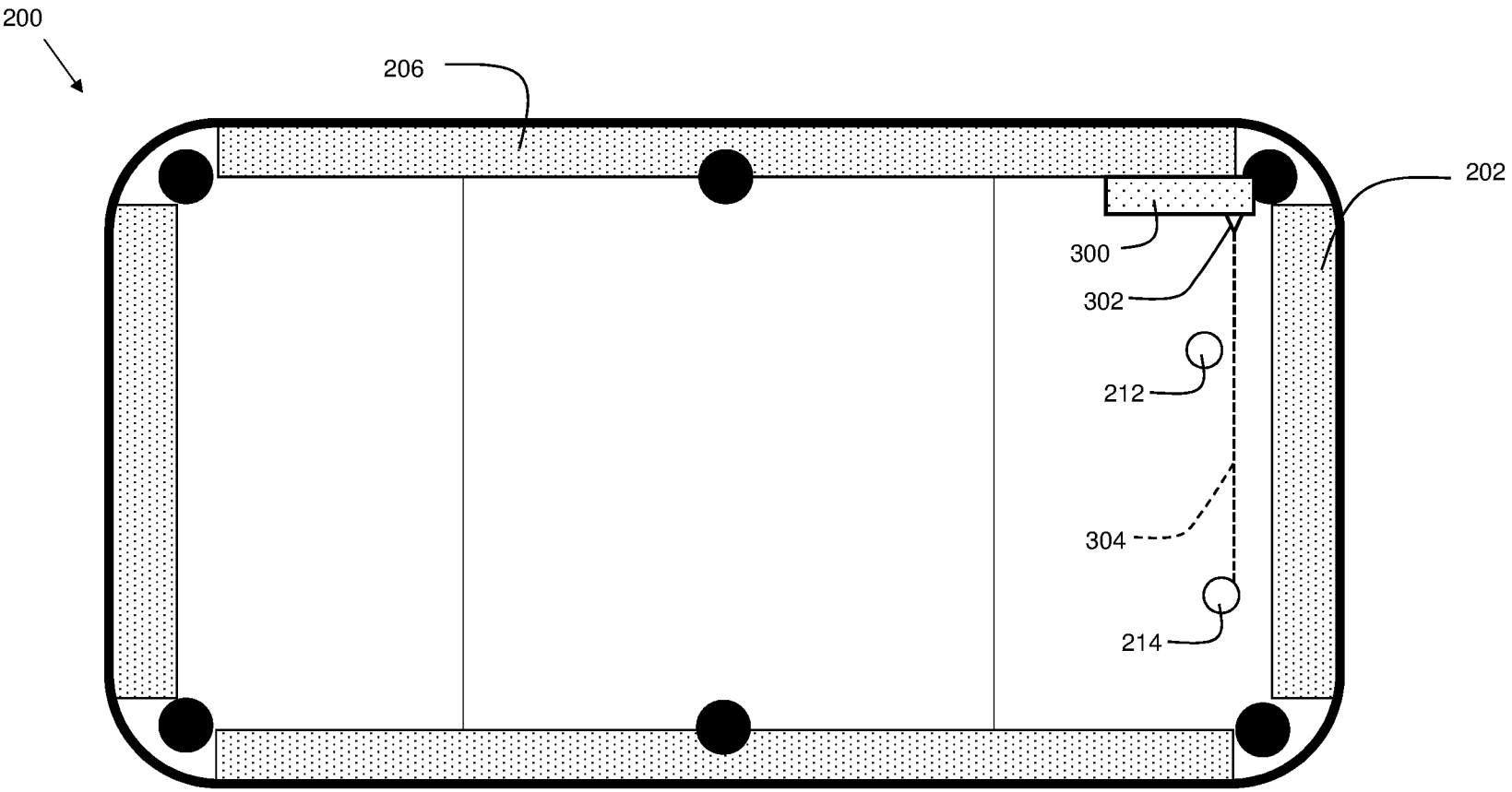
FIG. 3 illustrates a use of a lag winner determination device in accordance with an embodiment of the present invention.

FIG. 3 illustrates a use of a lag winner determination device 300 in accordance with an embodiment of the present invention. The lag winner determination device 300 includes an illumination source 302 which outputs a narrow light beam 304. The lag winner determination device (LWDD) 300 is placed along the side rail 206, such that the light beam 304 is oriented parallel to a long dimension of head rail 202. The light beam starting orientation is closest to the head rail 202 as possible. Then the illumination source 302 is gradually moved away from the head rail 202. This can be accomplished by moving the entire device 300 along the side rail 206, or moving the illumination source 302 within the device 300. The light beam 304 illuminates the ball that is closest to the head rail first as it is moved away from head rail 202. In this example, it can be seen that the second player, using ball 214 is the lag winner, since ball 214 is illuminated by light beam 304 while ball 212 of player 1 is not illuminated by light beam 304. Hence, disclosed embodiments enable accurate determination of a lag winner.

In some embodiments, the illumination source (light source) includes a laser. In embodiments, the laser comprises a helium-neon gas laser. In other embodiments, the laser comprises a diode laser. In still other embodiments, the laser includes a diode-pumped solid state laser. In some embodiments, the laser is configured to output light with a wavelength ranging from 400 nanometers to 750 nanometers. In some embodiments, the laser is configured to output light with a wavelength ranging from 495 nanometers to 570 nanometers, corresponding to green light. In some embodiments, the laser is configured to output light with a wavelength ranging from 620 nanometers to 750 nanometers, corresponding to red light. In some embodiments, the laser is configured to output light with a wavelength ranging from 450 nanometers to 494 nanometers, corresponding to blue light. These example wavelength ranges are non-limiting, and other colors of light may be used in some embodiments.

Figure 4:
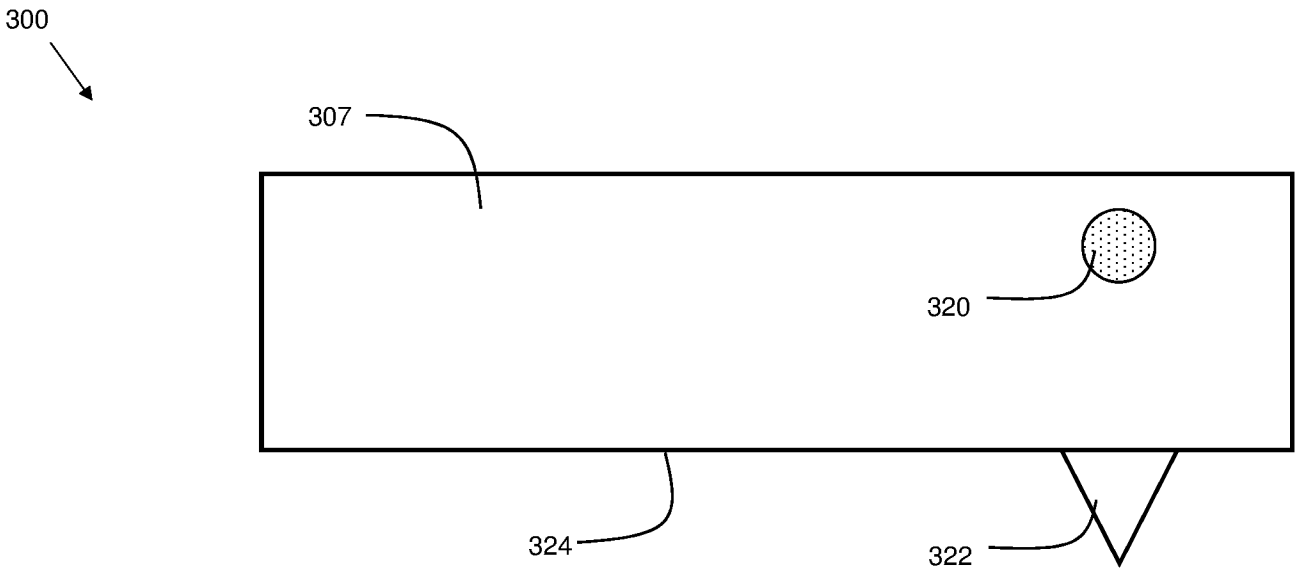
FIG. 4 shows details of a top-down view of a lag winner determination device in accordance with an embodiment of the present invention.

FIG. 4 shows details of a top-down view of a lag winner determination device in accordance with an embodiment of the present invention. Device 300 includes an enclosure 307. Disposed within the enclosure 307 is a power switch 320, and a light source (illumination source) 322 disposed on the light side 324 of the enclosure 307.

Figure 5:
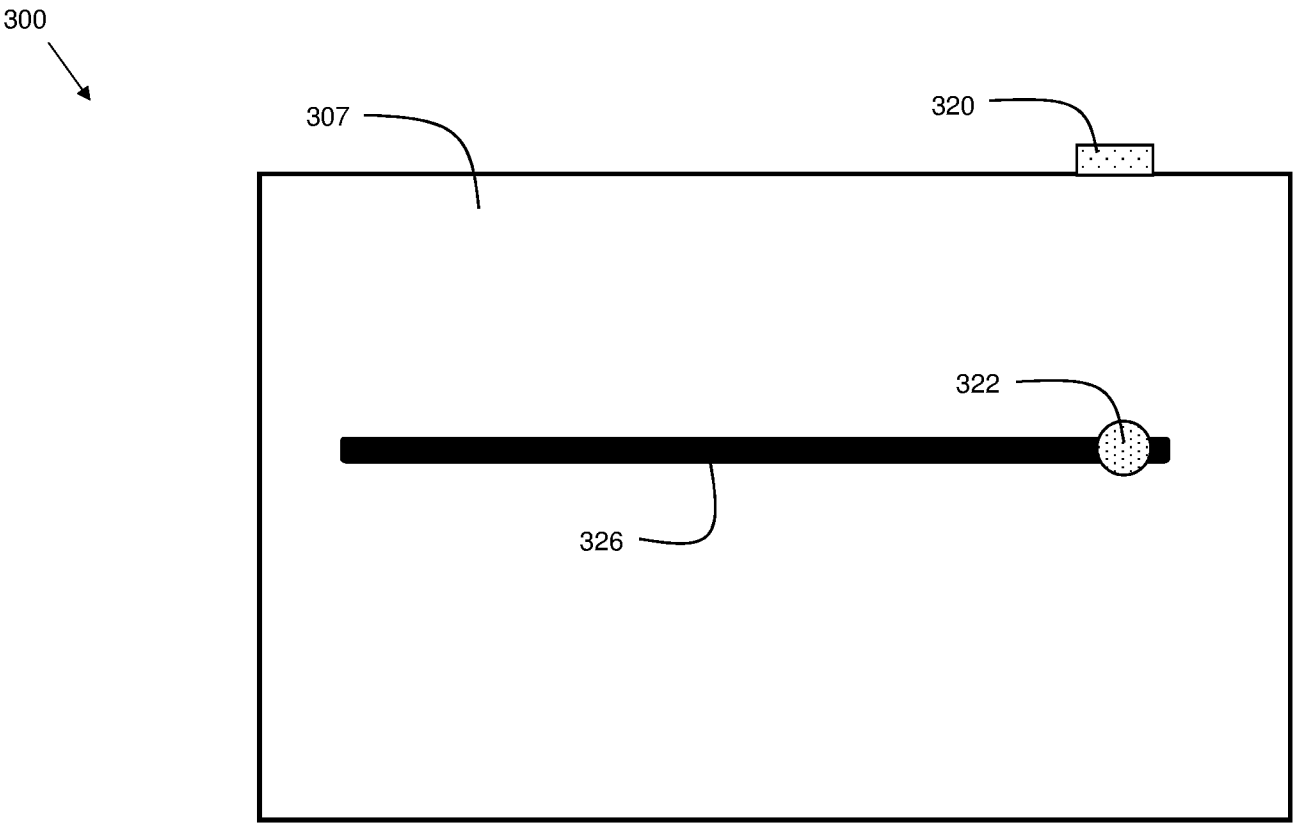
FIG. 5 shows details of a side view of a lag winner determination device in accordance with an embodiment of the present invention.

FIG. 5 shows details of the light side view of lag winner determination device 300 shown in FIG. 4. In this view, the power switch 320 is shown on the top surface of the enclosure 307. The power switch 320 may include, but is not limited to, a pushbutton switch, toggle switch, capacitive touch switch, or other suitable switch. The switch may be a momentary-on switch in some embodiments. Thus, in some embodiments using a pushbutton switch, the switch may only be on while a user is pressing the pushbutton switch. When the switch 320 is in the on position, the light source 322 is activated to emit light. In some embodiments, the light source 322 may be moveable along a rail 326. In some embodiments, a groove, or other guidance mechanism may be used instead of, or in addition to, the rail 326. The rail allows movement of the light source to determine the lag winner.

Figure 6:
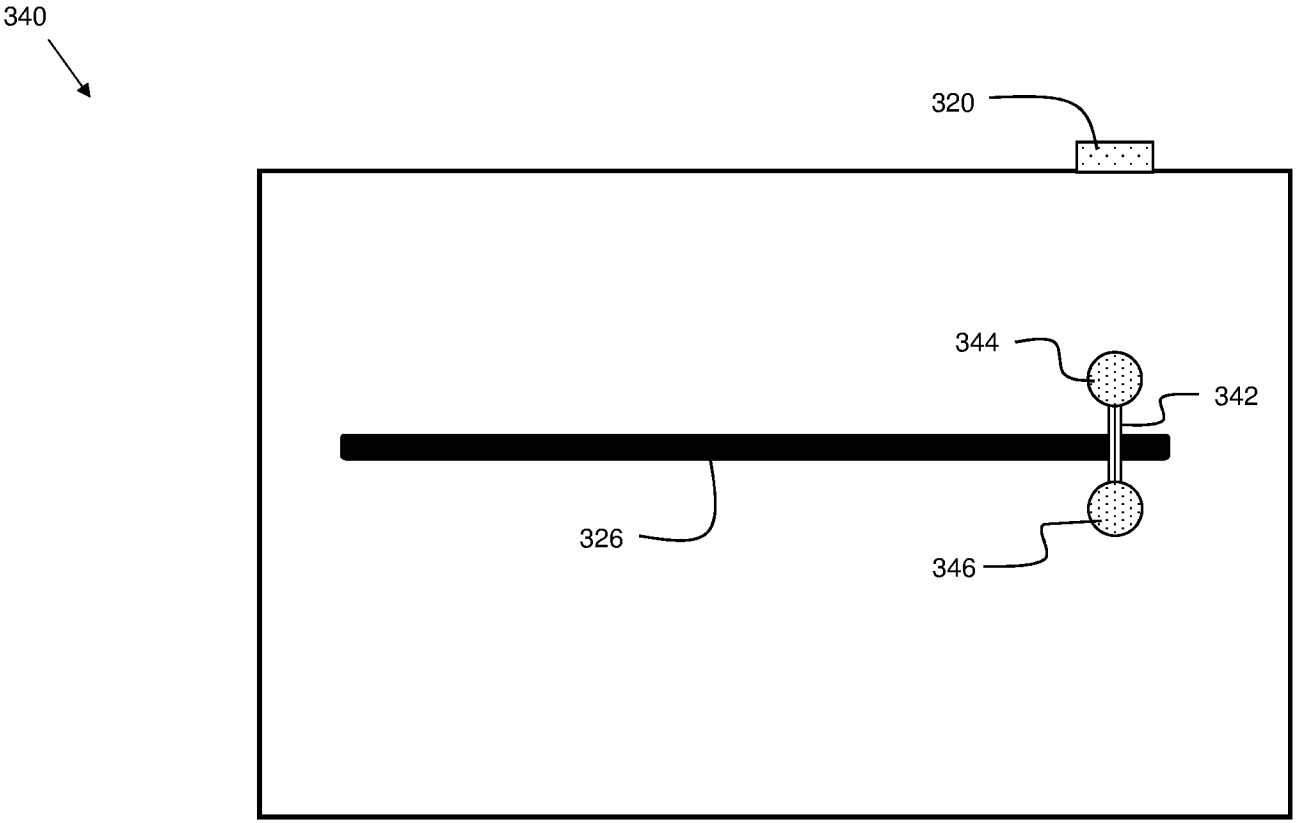
FIG. 6 shows details of a side view of a lag winner determination device in accordance with another embodiment of the present invention.

FIG. 6 shows details of a side view of a lag winner determination device 340 in accordance with another embodiment of the present invention. Device 340 is mostly similar to device 300 shown in FIG. 5, with the key difference being the use of a first light source 344 and a second light source 346 affixed to a light source bracket 342. In embodiments, the first light source 344 and the second light source 346 each emit light of a different wavelength, thus offering the possibility of using two colors of light. While in some cases, a lag may be performed using two white cue balls, in some cases, colored balls may be used. In such cases, some colors of light may be more easily visible on a given billiard ball, depending on its color.

For example, red light may be easier to see on a green billiard ball, while green light may be easier to visually identify on a red billiard ball. Thus, with the embodiment shown in FIG. 6, improved performance of the device may be realized by using various colors of billiard balls for the lag. Additional the embodiment of FIG. 6 can be beneficial when a user has any form of colorblindness where he/she is more sensitive to light of a particular color.

In embodiments, the first light source is a laser and is configured to output light at a first wavelength, and the second light source is a second laser is configured to output light at a second wavelength. In embodiments the laser and the second laser are oriented such that a light beam from the laser is oriented parallel to a light beam from the second laser. Thus, both light sources are configured such that emitted light from both sources travels in approximately the same direction.

Figure 7:
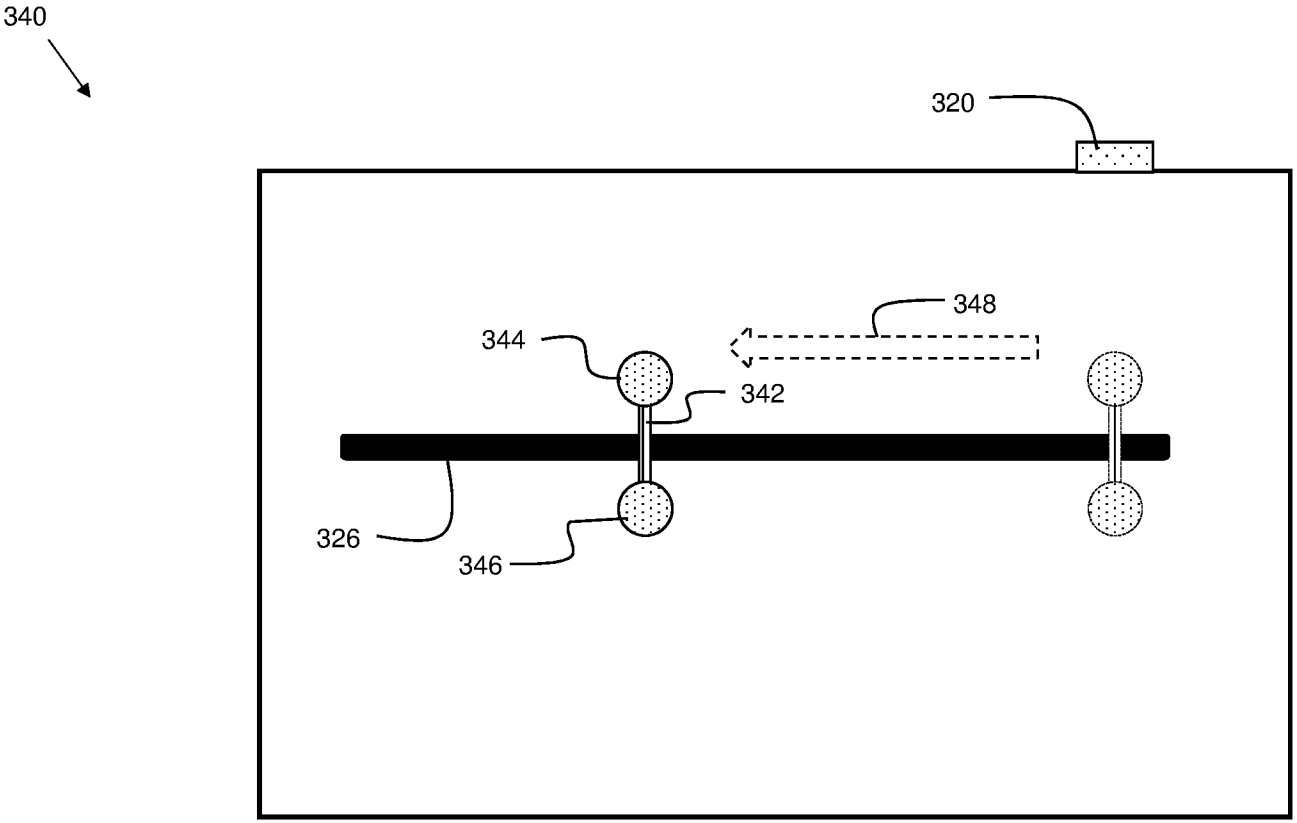
FIG. 7 shows operation of light source positioning.

FIG. 7 shows operation of light source positioning. This shows the embodiment of FIG. 6, with the light sources moved in the direction of arrow 348 along the rail 326. In this way, the light sources can be moved with fine adjustment to identify the billiard ball pertaining to the winning lag. Note that while FIG. 7 shows movement of light sources using the embodiment of FIG. 6 having two light sources, embodiments having one light source, or more than two light sources, can operate in a similar manner using rail 326. Thus, embodiments include a rail disposed along a longitudinal axis of the enclosure, where the laser is configured to move along the rail.

Figure 8:
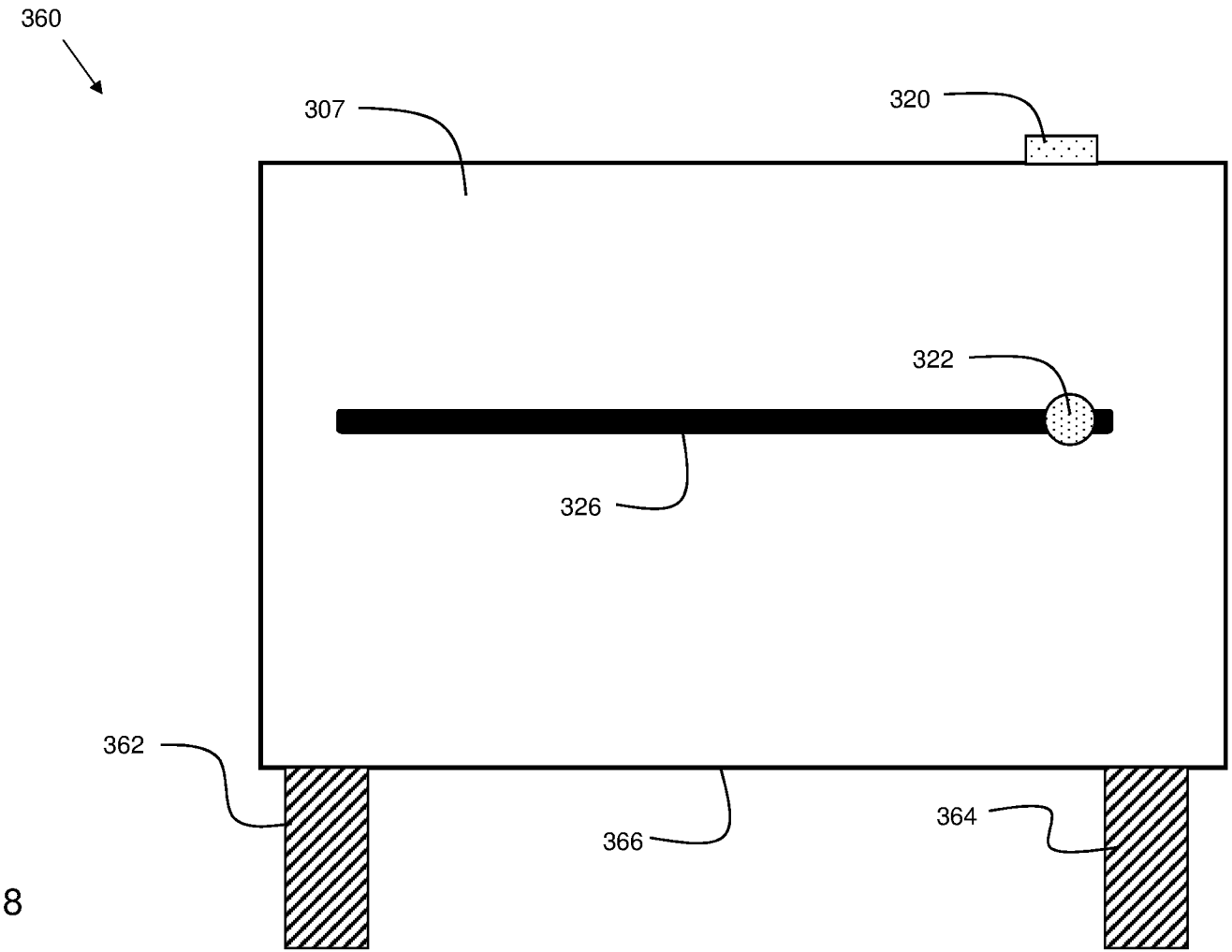
FIG. 8 shows details of a side view of a lag winner determination device in accordance with yet another embodiment of the present invention.

FIG. 8 shows details of a side view of a lag winner determination device 360 in accordance with yet another embodiment of the present invention. Device 360 is mostly similar to device 300 shown in FIG. 5, with a difference being a plurality of elongated supports (shown as 362 and 364) disposed on a bottom surface 366 of the enclosure 307.

Figure 9:
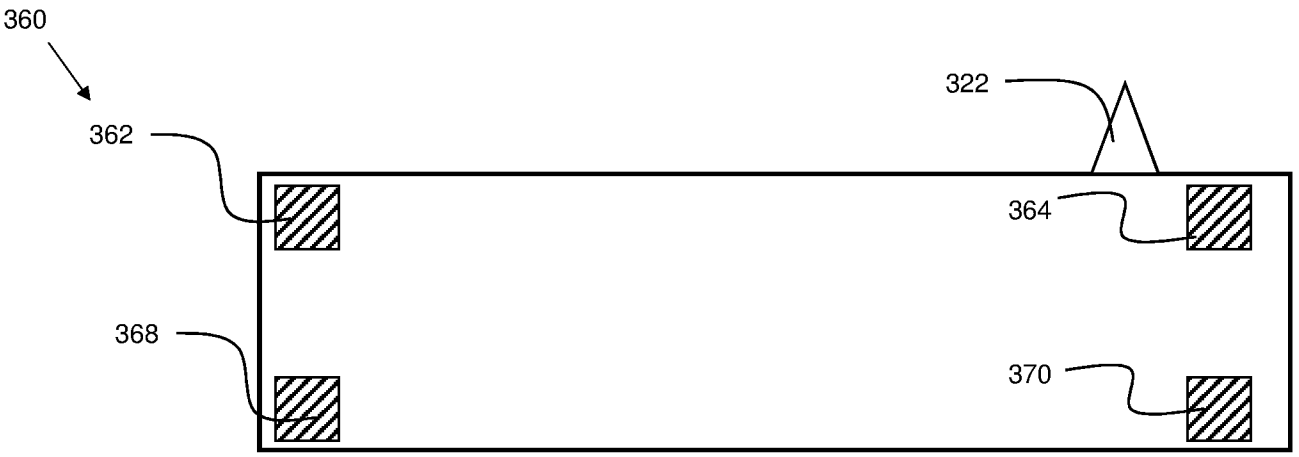
FIG. 9 shows details of a bottom-up view of the embodiment of FIG. 8.

FIG. 9 shows details of a bottom-up view of the embodiment of FIG. 8. The bottom-up view shows an embodiment with four elongated supports, indicated as 362, 364, 368, and 370.

Figure 10:
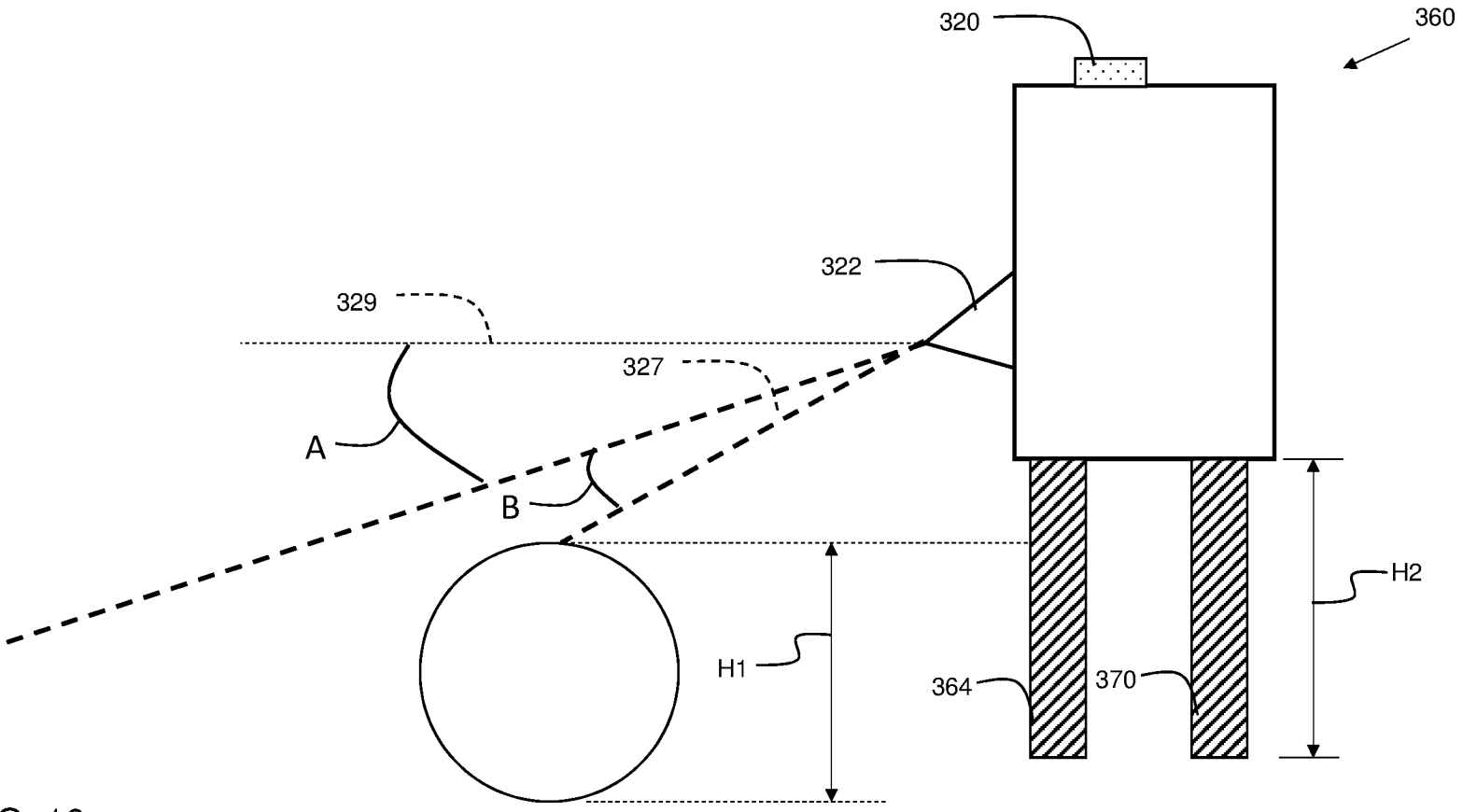
FIG. 10 shows usage of the embodiment of FIG. 8.

FIG. 10 shows usage of the embodiment of FIG. 8. As shown in FIG. 10, the device 360 is supported on elongated supports (364 and 370 are visible in this figure). In embodiments, the height H2 of the elongated supports is greater than the height H1 of a billiard ball. Billiard balls can vary in height, but most are less than three inches in diameter. Thus, in some embodiments, the elongated supports have a height H2 ranging from 3 to 3.5 inches. In this way, should a measurement need to be taken while other billiard balls are on the table, the height is such that in most cases, the device 360 can be used without disturbing any billiard balls that are on the table at the time of use. Further, such an implementation may be used for training purposes such as, but not limited to, lining up a proposed shot.

In embodiments that utilize elongated supports (legs), the light source 322 may be configured such that the light emitted is angled downward at an angle A from horizontal reference 329. In embodiments, angle A ranges from about 10 degrees to about 30 degrees. Additionally, light source 322 may be configured to emit a planar output of light 327 having an angle B. In embodiments, angle B ranges from about 10 degrees to about 30 degrees. In embodiments, the planar fan of light may be implemented by using a laser line lens on the front of light source 322. In some embodiments, a rotating mirror may be used as a line generator. Other laser line generation techniques may be used in embodiments of the present invention.

Figure 11:
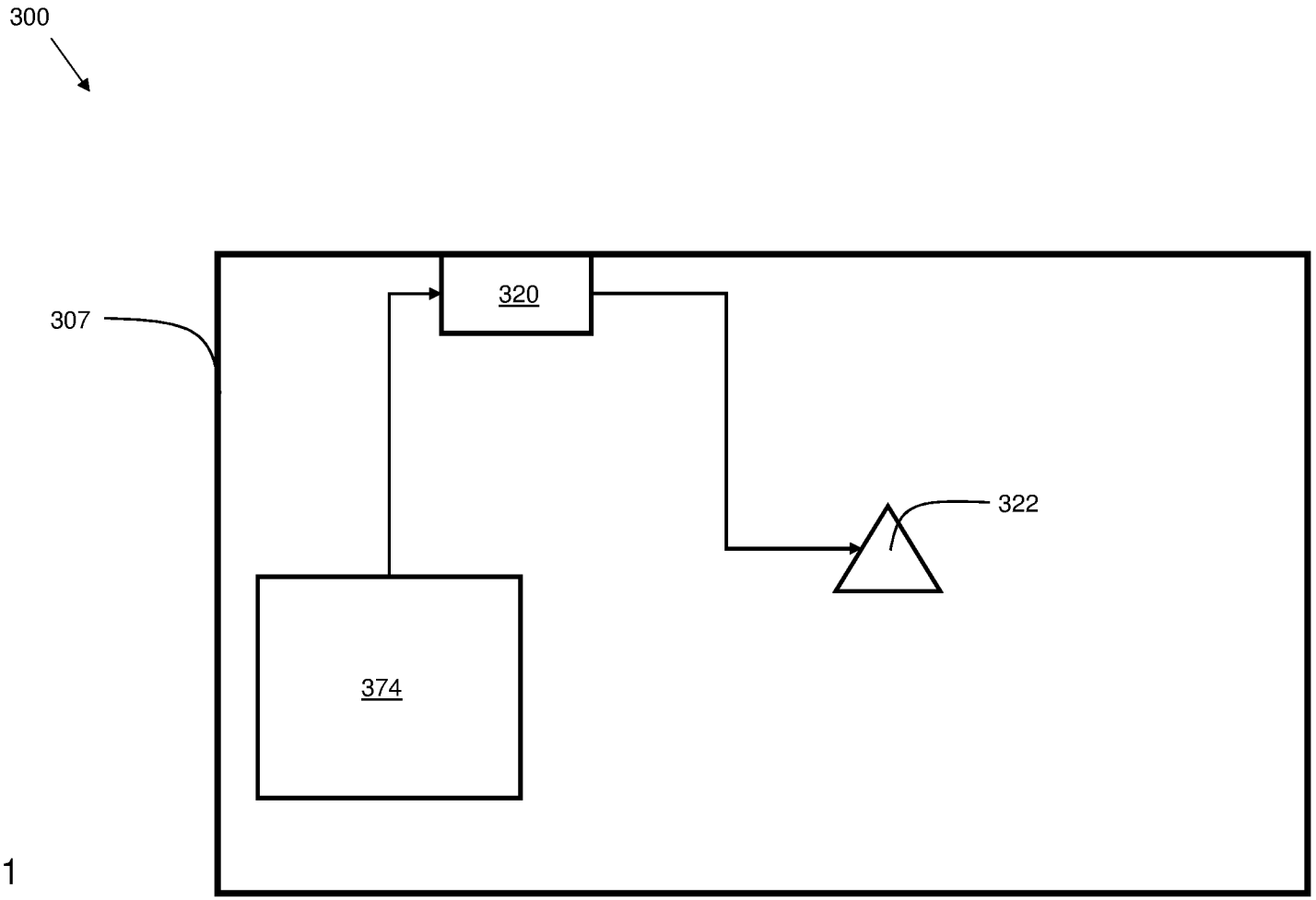
FIG. 11 shows a schematic diagram of an embodiment of the present invention.

FIG. 11 shows a schematic diagram of an embodiment of the present invention. A power source 374 is coupled to power switch 320. When power switch 320 is in an ON configuration, the light source 322 is activated to produce a beam or line of light used for determining a lag winner. In embodiments, the power source 374 is a battery. In embodiments, the power source 374 comprises a rechargeable battery. In embodiments, the rechargeable battery includes a nickel cadmium battery. In embodiments, the rechargeable battery includes a lithium ion battery. Other battery types may be used in some embodiments. In some embodiments, a wired power source (not shown) from an alternating current source (e.g. wall outlet) may be used.

Figure 12:
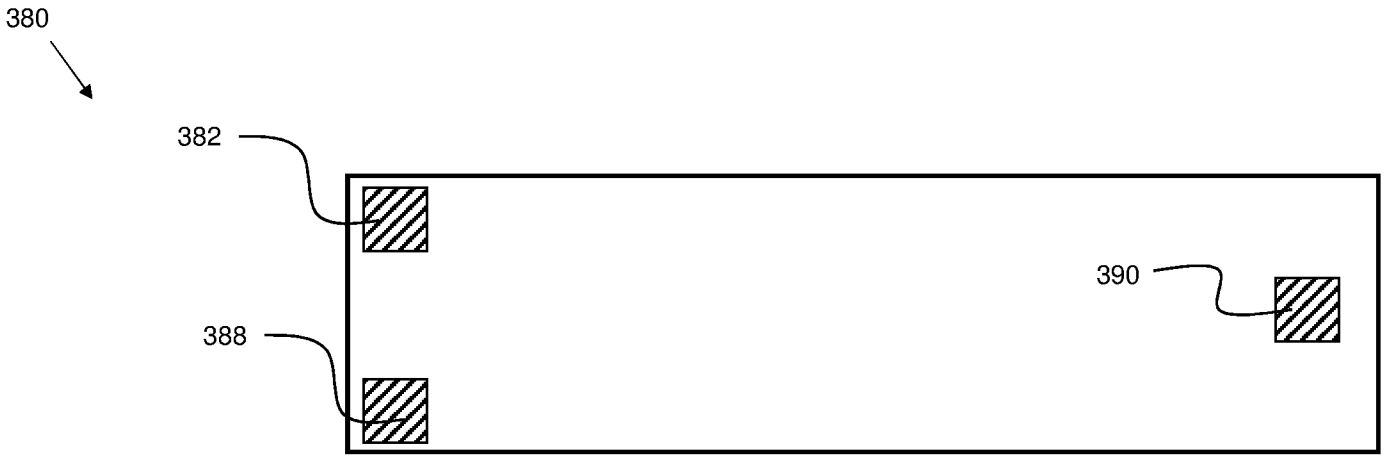
FIG. 12 shows details of a bottom-up view of yet another embodiment of the present invention.

FIG. 12 shows details of a bottom-up view of yet another embodiment of the present invention. Device 380 is mostly similar to device 360 shown in FIGS. 8-10, with a difference being the use of three elongated supports (382, 388, and 390). Since three points define a plane, the embodiment of FIG. 12 is stable, while having a reduced contact area of table surface with the elongated supports.

As can now be appreciated, disclosed embodiments provide techniques for determining the lag winner in a billiards game. This can be difficult to perform by human eye when the two players have a close lag. Disclosed embodiments utilize a light source such as a laser light source to identify which ball is closer to the head rail after the lag, and thus accurately determine a winner. In addition to determining a winner of a lag, the apparatus disclosed herein can have other billiards applications, such as use as a training tool for difficult and/or trick shots. This can be accomplished by aiming the light source at the desired point on a ball to determine an appropriate path for the shot.

In yet another embodiment of the present invention, there may be an electronic system that interfaces with or works in conjunction with the lag winner determination device 300. For example, a user may utilize an application running on an electronic device (i.e. smart phone, smart watch, tablet, or other computing device). This application may receive data from the lag winner determination device 300 to create representations of the lag determination on a display screen associated with the electronic device. Overlays may appear on the display screen illustrating various measurements, lines, calculations, lag winners, etc. This information may be communicated to other electronic devices or otherwise communicated to those partaking in the gameplay and officiating/spectating such that a winner of the lag is clearly announced and determined.

Further, an optical device, such as a camera, coupled to the electronic device may be able to capture a representation of the playing area after each player has lagged, or before or after each individual player has completed their lag. The representation captured by the electronic device can then be analyzed by the application to determine a lag winner. In such a scenario, the representation, be it a static or time varying image, is analyzed by a processor to determine objects located in the representation such that identification of the necessary locations (e.g. player 1 ball, player two ball, table rails, etc.) are appropriately identified allowing for a distance measuring algorithm to calculate the winner of the lag.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although the embodiments have been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A method for determining a winner for a lag in a billiards game occurring on a billiards table, comprising:

placing a lag winner determination device such that the device is alongside a side rail of the billiards table and closer to a head rail of the billiards table than billiard balls used in the lag; activating an illumination source within the lag winner determination device; moving the illumination source until the illumination source provides incident light to one of the billiard balls used in the lag; and determining the winner as a player that used the billiard ball that received incident light from the illumination source.

2. The method of claim 1, wherein activating an illumination source comprises activating a laser.

3. The method of claim 2, wherein activating a laser comprises activating a helium-neon gas laser.

4. The method of claim 2, wherein activating a laser comprises activating a diode laser.

5. The method of claim 4, wherein activating a diode laser comprises activating a diode laser with a light wavelength ranging from 400 nanometers to 750 nanometers.

* * * * *